US010083803B2

(12) United States Patent
Takeuchi

(10) Patent No.: US 10,083,803 B2
(45) Date of Patent: Sep. 25, 2018

(54) CLICK MECHANISM FOR SWITCH

(71) Applicant: KABUSHIKI KAISHA TOKAI RIKA DENKI SEISAKUSHO, Aichi (JP)

(72) Inventor: Motoya Takeuchi, Aichi (JP)

(73) Assignee: KABUSHIKI KAISHA TOKAI RIKA DENKI SEISAKUSHO, Aichi (JP)

( * ) Notice: Subject to any disclaimer, the term of this patent is extended or adjusted under 35 U.S.C. 154(b) by 86 days.

(21) Appl. No.: 14/532,463

(22) Filed: Nov. 4, 2014

(65) Prior Publication Data

US 2015/0129405 A1 May 14, 2015

(30) Foreign Application Priority Data

Nov. 12, 2013 (JP) ..... 2013-234201

(51) Int. Cl.
*H01H 19/06* (2006.01)
*H01H 13/02* (2006.01)

(52) U.S. Cl.
CPC ..... *H01H 13/02* (2013.01); *H01H 2215/03* (2013.01); *H01H 2300/01* (2013.01)

(58) Field of Classification Search
CPC . H01H 13/02; H01H 2215/03; H01H 2300/01
USPC ..... 200/339, 341, 553, 556, 557, 302.3
See application file for complete search history.

(56) References Cited

U.S. PATENT DOCUMENTS 5,446,253 A * 8/1995 Oshgan ..... G05G 1/00 200/553
6,388,221 B1 * 5/2002 Rudolph ..... H01H 23/04 200/339
7,960,664 B2 * 6/2011 Inoue ..... H01H 23/22 200/339
2009/0057120 A1 * 3/2009 Kakuno ..... H01H 21/24 200/339
2013/0180836 A1 7/2013 Neriki et al.
2013/0213787 A1 * 8/2013 Laicher ..... H01H 23/003 200/557

FOREIGN PATENT DOCUMENTS

CN 1790577 6/2006
CN 201845689 5/2011
(Continued)

OTHER PUBLICATIONS

Office Action issued in China Counterpart Patent Appl. No. 201410635721.X, dated Apr. 19, 2016 , along with an English translation thereof.

*Primary Examiner* — Edwin A. Leon
*Assistant Examiner* — Lheiren Mae A Caroc
(74) *Attorney, Agent, or Firm* — Greenblum & Bernstein, P.L.C.

(57) ABSTRACT

A click mechanism for a switch includes a button that is operable by a user, a click generation surface formed on the button or a body to which the button is coupled, an urging mechanism, and a pusher pushed against the click generation surface by the urging force of the urging mechanism and slidable on the click generation surface in response to operation of the button. The pusher is configured to apply tactile force to the button when sliding on the click generation surface. The click generation surface includes at least one groove.

8 Claims, 3 Drawing Sheets

(56) References Cited

FOREIGN PATENT DOCUMENTS

| | | |
|---|---|---|
| JP | 4-66017 | 6/1992 |
| JP | 7-22435 | 4/1995 |
| JP | 2010-27496 | 2/2010 |

* cited by examiner

Add groove to click generation surface
(sloped surface)

(Enlarged View)

CLICK MECHANISM FOR SWITCH

CROSS-REFERENCE TO RELATED APPLICATIONS

This application is based upon and claims the benefit of priority from prior Japanese Patent Application No. 2013-234201, filed on Nov. 12, 2013, the entire contents of which are incorporated herein by reference.

FIELD

The present invention relates to a click mechanism for a switch that applies tactile force to a switch button when the switch button is operated.

BACKGROUND

Unexamined Utility Model Publication No. 7-22435 describes a power window switch including a click mechanism. The switch device includes a body, which includes a click generation surface, and a pusher, which is held at a neutral position on the click generation surface and pushed by the urging force of a spring against the click generation surface. When a user operates the switch button, the pusher slides on the click generation surface. This applies a tactile force to the switch button and generates a click, which is perceived by the user. When the switch button is released, the pusher returns to the neutral position.

SUMMARY

In a vehicle, dust may enter the switch device. The collection of dust between the pusher and the click generation surface may cause a switching failure. Further, the switch button may become stuck.

One aspect of the present invention is a click mechanism for a switch. The click mechanism includes a button that is operable by a user, a click generation surface formed on the button or a body to which the button is coupled, an urging mechanism, and a pusher pushed against the click generation surface by an urging force of the urging mechanism and slidable on the click generation surface in response to operation of the button. The pusher is configured to apply tactile force to the button when sliding on the click generation surface. The click generation surface includes at least one groove.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which:

FIG. 4A illustrates a cross-sectional view taken along line A-A in FIG. 4B, and FIG. 4C illustrates a partial enlarged view of FIG. 4A.

DESCRIPTION OF THE EMBODIMENTS

One embodiment of a switch device including a click mechanism will now be described.

Figure 1:
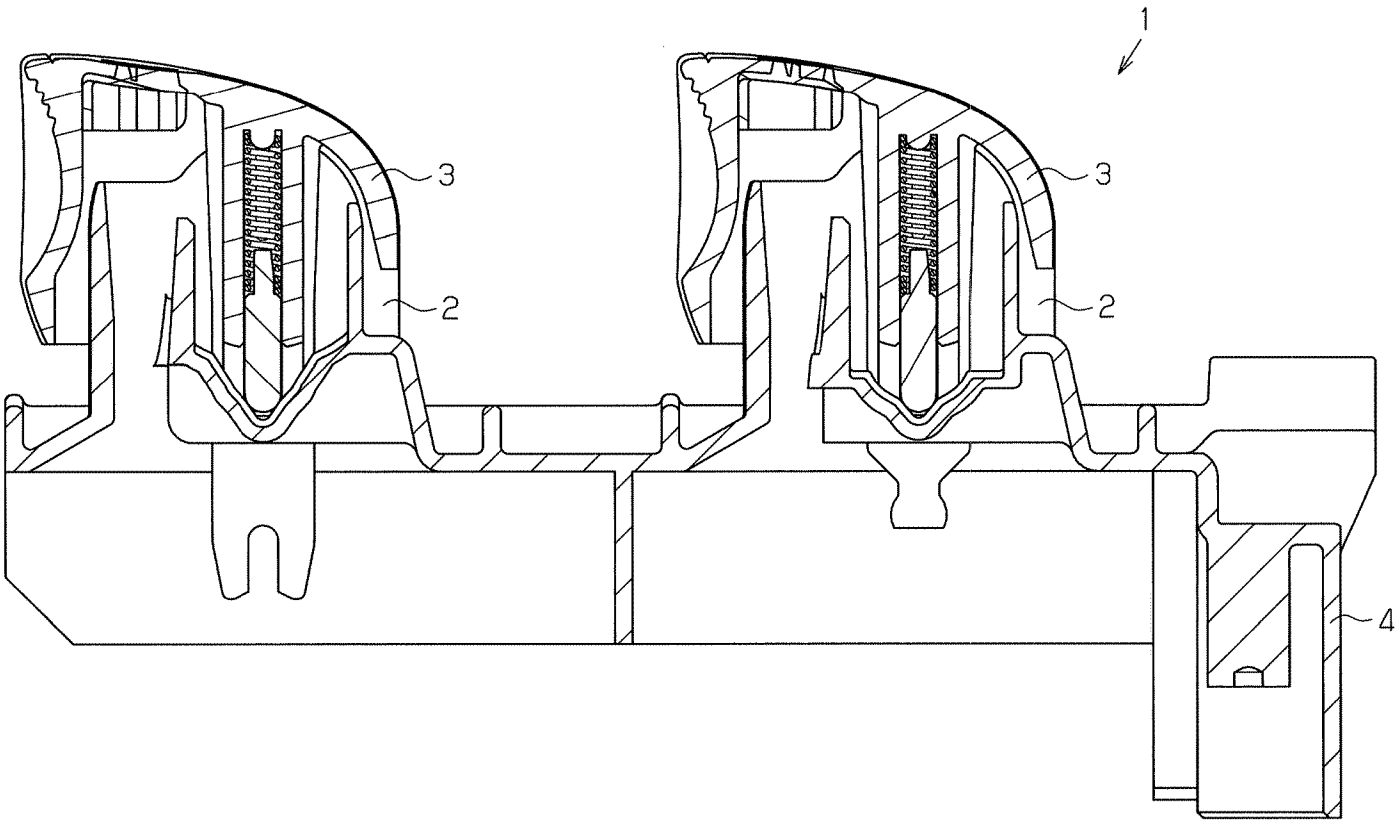
FIG. 1 is a schematic cross-sectional view of a power window switch.

As illustrated in FIG. 1, a power window switch 1, which serves as a switch device, includes a plurality of switch structures 2. FIG. 1 illustrates two switch structures 2. The power window switch 1 is, for example, mounted on an armrest in a vehicle. The switch structures 2 are identical to one another. Each switch structure 2 includes a user-operable switch button (hereafter, simply referred to as the button) 3. Each button 3 is coupled at a certain location to a switch body (hereafter, simply referred to as the body) 4, which is shared by two switch structures 2. The body 4 is formed from, for example, acrylonitrile butadiene styrene (ABS).

Figure 2:
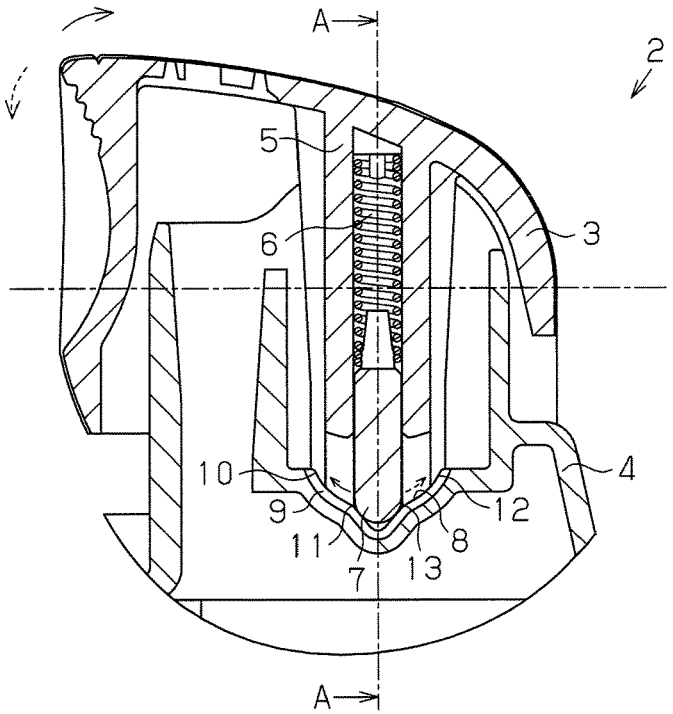
FIG. 2 is a cross-sectional view of a switch structure illustrated in FIG. 1.

As illustrated in FIG. 2, the button 3 includes a tube 5, which extends down toward the body 4, and a spring 6, which is accommodated in the tube 5. The tube 5 includes an open end and a closed end located at the opposite side of the open end. The closed and forms an end wall of the tube 5. The spring 6 includes a basal end, which is fixed to the end wall of the tube 5, and a distal end, which is coupled to a pusher 7. Thus, the basal end of the spring 6 functions as a fixed end, and the distal end of the spring 6 functions as a free end. The pusher 7 is formed from, for example, polyacetal. The body 4 includes a click generation surface 8. The urging force of the spring 6 pushes the pusher 7 against the click generation surface 8 of the body 4. When the pusher 7 is not operated, the spring 6 holds the pusher 7 at a neutral position on the click generation surface 8.

As illustrated by the solid line arrow in FIG. 2, when the button 3 is raised in a diagonally rightward direction, the pusher 7 slides on the click generation surface 8 from the neutral position to a first sloped surface 10 (diagonally upward to the left as viewed in FIG. 2). As the pusher 7 moves over a click ridge 11 formed in the first sloped surface 10, the pusher 7 generates a click (tactile force) that is applied to the button 3 through the spring 6. When the button 3 is released, the pusher 7 returns to the neutral position.

As illustrated by the broken line arrow in FIG. 2, when the button 3 is lowered in a diagonally leftward direction, the pusher 7 slides on the click generation surface 8 from the neutral position to a second sloped surface 12 (diagonally upward to the right as viewed in FIG. 2). As the pusher 7 moves over a click ridge 13 formed in the second sloped surface 12, the pusher 7 generates a click (tactile force) that is applied to the button 3 through the spring 6. When the button 3 is released, the pusher 7 returns to the neutral position.

In the present embodiment, the click mechanism for the switch 1 is realized by the click generation surface 8 formed on the surface of the body 4, the pusher 7, and an urging mechanism (spring 6, in the present example).

Figure 3:
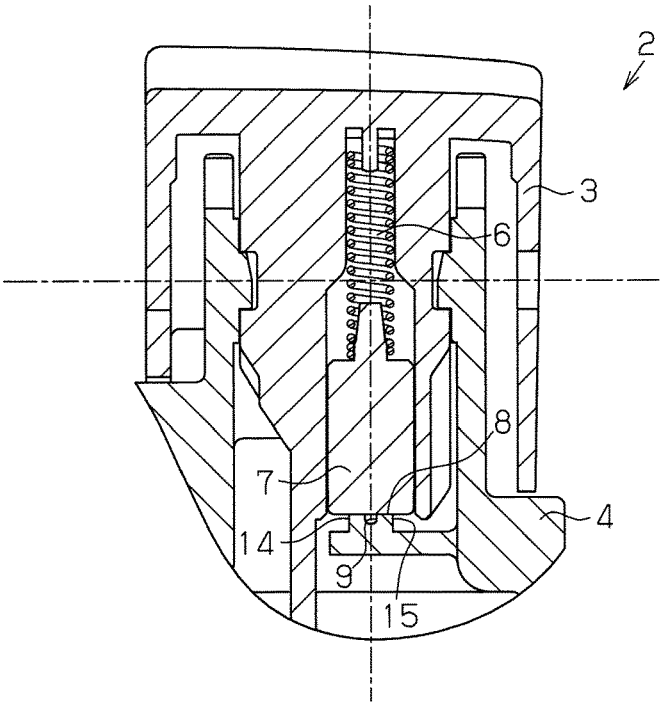
FIG. 3 is a cross-sectional view taken along line A-A in FIG. 2.

As illustrated in FIG. 3, the click generation surface 8 includes a single groove 9. That is, the click generation surface 8 includes two ribs 14 and 15 that define the groove 9. The groove 9 and the ribs 14 and 15 extend in the sliding direction of the pusher 7. The pusher 7 includes a distal end that traverses the groove 9 and is in linear contact with the upper surfaces of the ribs 14 and 15. Thus, the pusher 7 is in linear contact with the click generation surface 8 in a direction orthogonal to the groove 9. Further, the pusher 7 remains in linear contact with the click generation surface 8 while sliding along the groove 9 on the click generation surface 8. The groove 9 is formed in a middle portion of the click generation surface 8 in the direction of linear contact.

Grease 16 is applied between the pusher 7 and the click generation surface 8. Thus, as illustrated in FIG. 4C, the groove 9 in the click generation surface 8 is filled with grease 16.

The operation of the power window switch 1 will now be described.

Dust suspended in the air may be drawn into the switch structure 2 by negative pressure. The dust may enter a gap between the pusher 7 and the click generation surface 8.

Figure 4A:
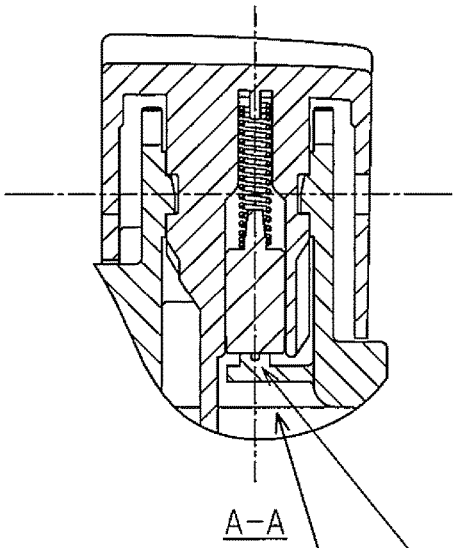
FIGS. 4A, 4B and 4C are cross-sectional views of the switch structure, where
Figure 4B:
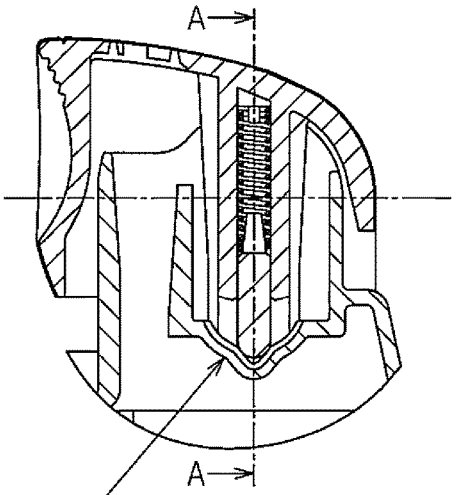
Figure 4C:
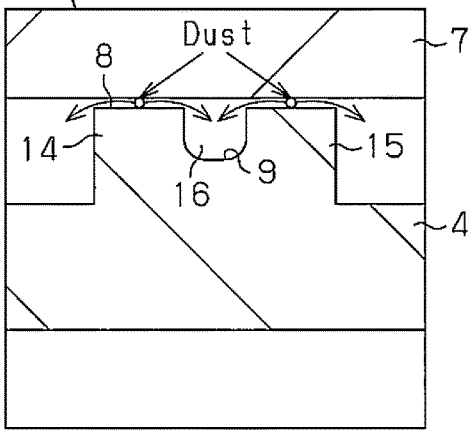

Referring to FIG. 4C, at least some of the dust entering the gap between the pusher 7 and the click generation surface 8 falls into the groove 9 or the surrounding area outside the click generation surface 8 when the pusher 7 moves (slides) on the click generation surface 8. This reduces the amount of dust that collects between the pusher 7 and the click generation surface 8. Thus, when the button 3 is operated, the pusher 7 smoothly slides on the click generation surface 8. When the button 3 is released, the pusher 7 smoothly returns to the neutral position.

Further, when wear or abrasion occurs in the click generation surface 8 due to dust or frequent operation of the button 3, abrasive grains collect between the pusher 7 and the click generation surface 8. In the same manner as dust, the abrasive grains also fall into the groove 9 or the surrounding area when the pusher 7 slides on the click generation surface 8. Additionally, wear or abrasion of the click generation surface 8 causes the grease 16 to move out of the groove 9. This maintains the grease 16 on the click generation surface 8 and ensures that the grease 16 continues to be effective.

The present embodiment has the advantages described below.

(1) At least some of the dust entering the gap between the pusher 7 and the click generation surface 8 falls into the groove 9. This limits operation failures of the switch 1. Further, the switch 1 does not become stuck. Thus, the dust resistance may be improved.

(2) The groove 9 in the click generation surface 8 is filled with the grease 16. When wear or abrasion occurs in the click generation surface 8 due to dust or frequent operation of the button 3, the grease 16 moves out of the groove 9. This maintains the grease 16 on the click generation surface 8 and ensures that the grease 16 continues to be effective over a long period.

(3) The groove 9 extends in the sliding direction of the pusher 7. This allows dust to easily enter the groove 9 when the pusher 7 slides.

(4) The pusher 7 is in linear contact with the click generation surface 8. That is, when viewing the pusher 7 from the sliding direction, the distal end of the pusher 7 is shaped straight (refer to FIG. 3). This limits wear in the click generation surface 8 and improves the durability compared to when a pusher is in point contact with a click generation surface (e.g., when the distal end of the pusher is spherical).

(5) The groove 9 is formed in the middle portion of the click generation surface 8 in the -direction of linear contact. Thus, dust easily falls into the groove 9 when the pusher 7 slides.

(6) The switch structure 2 may be sealed to prevent the entrance of dust. However, this would increase costs. Since the switch structure 2 does not necessarily have to be sealed, costs are reduced.

(7) The switch structure 2 may be sealed. However, even when sealed, the switch structure 2 would be affected by abrasive grains if the groove 9 were to be omitted. Accordingly, by providing the switch structure 2 with the groove 9, the influence of abrasive grains, in addition to dust, are reduced.

(8) In lieu of the body 4 (click generation surface 8) including the groove 9, the pusher 7 may include a groove. In such a case, however, it would be difficult to form the groove over a wide region in the pusher 7. As a result, in such a structure, dust would continue to remain on the click generation surface 8 after the pusher 7 slides, and satisfactory tactile force may not be applied to the button 3 due to dust. In the present embodiment, the body 4 includes the groove 9. Thus, the groove 9 may be formed over a wide region in the click generation surface 8. As a result, dust easily falls into the groove 9 when the pusher 7 slides and satisfactory tactile force may be applied to the button 3.

It should be apparent to those skilled in the art that the present invention may be embodied in many other specific forms without departing from the spirit or scope of the invention. Particularly, it should be understood that the present invention may be embodied in the following forms.

In the above embodiment, the pusher 7 is in linear contact with the click generation surface 8. As described above, such linear contact reduces wear or abrasion in the click generation surface 8 as compared to point contact. In such a structure, two or more grooves 9 may be formed in the click generation surface 8 in accordance with the extent of wear or abrasion that corresponds to the length of linear contact.

Further, in the above embodiment, the shape (width or the like) of the groove 9 may be changed in accordance with the extent of wear or abrasion that corresponds to the length of linear contact.

The groove 9 does not need to have a width and depth that are uniform in the sliding direction.

When using a plurality of the grooves 9, each groove 9 may have a different width or length.

When using a plurality of the grooves 9, the intervals between the grooves 9 do not have to be same.

The groove 9 does not have to be formed throughout the pusher 7 in the sliding direction. The formation of the groove 9 may be formed to a limited location where dust and abrasive grains may be efficiently dropped into the groove 9 or the surrounding area outside the click generation surface 8 when the pusher 7 slides on the click generation surface 8.

The groove 9 may be curved.

As long as the click generation surface 8 includes one groove 9, the pusher 7 may also include a groove.

The click mechanism of any one of the above embodiment and the above modifications may be applied to a switch device other than the power window switch 1. Further, the switch device is not limited to a switch used in a vehicle.

The click mechanism of any one of the above embodiment and the above modifications may be applied to a switch device including a single switch structure 2. When applying the click mechanism of any one of the above embodiment and the above modifications to a switch device including a plurality of the switch structures 2, it is preferable that the groove 9 be formed in the click generation surface 8 of each switch structure 2.

The switch device is not restricted to a structure that slides the pusher 7 selectively to two positions from the neutral position. The switch device may slide the pusher 7 to a single position from the neutral position or slide the pusher 7 selectively to three or more positions from the neutral position. Further, the neutral position may be omitted from the switch device, and the pusher 7 may slide between a plurality of positions. In this manner, the switch device may be a momentary switch or a stationary switch. For example, the switch device may slide the pusher 7 selectively to front, rear, left, and right positions from the neutral position. Further, when the pusher 7 slides (button 3 is operated), the tactile force applied to the button 3 may differ in accordance to where the pusher 7 slides.

A structure that seals the switch structure 2 to block the entrance of dust while dropping abrasive grains into the groove 9 may be employed.

Although it is desirable that the grease 16 cooperate with the groove 9 so that dust and abrasive grains fall into the groove 9 or outside the click generation surface 8, the grease 16 may be omitted.

The grease 16 may be formed from any substance as long as the required viscosity or the like can be obtained.

The spring 6 may be of any type or have any shape as long as it can urge the pusher 7 toward the click generation surface 8.

In lieu of the spring 6, an urging mechanism that urges the pusher 7 with electromagnetic force may be employed. This allows the tactile force to be easily varied.

The material of the body 4 is not limited to ABS.

The switch structure may include a button coupling portion that is separate from the body 4, and the button 3 may be coupled to the button coupling portion. In this case, the body 4 and the button coupling portion may be integrally formed by performing two-color molding using different resins. In this modification, the click generation surface 8 may be formed on the button coupling portion instead of the body 4. In this case, the click generation surface 8 of the button coupling portion may include the groove 9.

The pusher 7 does not have to be formed from polyacetal.

In the above embodiment, the click generation surface 8 is formed on the body 4, and the pusher 7 is included in the button 3. Instead, a click generation surface may be formed on a switch button, and a pusher may be included in a switch body. In this case, the click generation surface of the button may include a groove.

The present examples and embodiments are to be considered as illustrative and not restrictive, and the invention is not to be limited to the details given herein, but may be modified within the scope and equivalence of the appended claims.

The invention claimed is:

1. A click mechanism for a switch, the click mechanism comprising:

a button that is operable by a user;

a pusher configured to apply a tactile force to the button;

a click generation surface formed on the button or a body to which the button is coupled, wherein the click generation surface is defined by a plurality of curved surfaces which extend contiguous with each other in a sliding direction of the pusher;

an urging mechanism; and the pusher being pushed against the click generation surface by an urging force of the urging mechanism and slidable on the click generation surface in response to operation of the button, wherein the pusher is configured to apply the tactile force to the button when sliding on the click generation surface, wherein at least one dust groove is cut in the click generation surface to receive dust that is drawn into the switch, wherein a bottom surface of the at least one dust groove is recessed downwardly from the click generation surface to allow the dust drawn into the switch to enter the at least one dust groove from the click generation surface when the pusher slides, the at least one dust groove being defined and extending longitudinally between opposing ribs that protrude upwardly such that upper surfaces of the opposing ribs form the click generation surface, wherein the opposing ribs are spaced apart from each other in a groove width direction that is perpendicular to the sliding direction of the pusher, and a surface of the pusher that is pushed against the click generation surface spans a width of the at least one dust groove in the groove width direction such that the surface of the pusher that is pushed against the click generation surface is spaced apart from the bottom surface of the at least one dust groove.

2. The click mechanism according to claim 1, wherein the at least one dust groove extends in a sliding direction of the pusher.

3. The click mechanism according to claim 1, further comprising grease applied between the pusher and the click generation surface.

4. The click mechanism according to claim 3, wherein the dust groove is filled with the grease.

5. The click mechanism according to claim 1, wherein the pusher is arranged to traverse the dust groove and be in linear contact with the click generation surface.

6. The click mechanism according to claim 5, wherein the pusher is slidable on the click generation surface in a direction orthogonal to a direction the pusher comes into linear contact with the click generation surface, and the dust groove is located in a middle portion of the click generation surface in the direction the pusher comes into linear contact with the click generation surface, and the dust groove extends in the sliding direction of the pusher.

7. The click mechanism according to claim 1, wherein the pusher includes a distal end that traverses the dust groove and is in linear contact with the upper surfaces of the opposing ribs that form the click generation surface.

8. The click mechanism according to claim 1, wherein the at least one dust groove comprises a plurality of undulations extending in the sliding direction of the pusher.

* * * * *